United States Patent [19]

Jamison

[11] 3,995,905

[45] Dec. 7, 1976

[54] METHOD AND APPARATUS FOR ROOF BOLTING AND TRANSFERRING MINED MATERIAL

[75] Inventor: Will B. Jamison, Bethel Park, Pa.

[73] Assignee: Consolidation Coal Company, Pittsburgh, Pa.

[22] Filed: Mar. 3, 1975

[21] Appl. No.: 554,535

[52] U.S. Cl. ..... 299/11; 299/18; 299/33; 61/63; 299/30

[51] Int. Cl.[2] ..... E21C 35/22; E21C 35/24

[58] Field of Search ..... 299/11, 12, 18, 33, 299/64; 61/63; 198/92; 173/52

[56] References Cited

UNITED STATES PATENTS

| | | | |
|---|---|---|---|
| 2,904,319 | 9/1959 | Newton | 299/33 |
| 3,210,122 | 10/1965 | Moon | 299/30 |
| 3,268,258 | 8/1966 | Kegel | 299/18 |
| 3,574,405 | 4/1971 | Shimada et al. | 299/18 X |
| 3,842,610 | 10/1974 | Willis et al. | 61/63 |

*Primary Examiner*—Ernest R. Purser
*Attorney, Agent, or Firm*—William A. Mikesell, Jr.; Stanley J. Price, Jr.

[57] ABSTRACT

A self-propelled body portion has spaced parallel vertical plate members that form a longitudinal passageway in which is positioned an endless conveyor. The conveyor includes a material receiving end portion that is maintained in underlapping relationship with the conveyor of a continuous mining machine that dislodges material from the face of the mine and deposits the material onto the receiving end portion of the conveyor. The conveyor transfers the mined material longitudinally of the body portion to a discharging end portion that pivots about a vertical axis relative to the main conveyor and discharges the mined material into a shuttle car. A pair of horizontally extensible drill booms are pivotally mounted to opposed sides of the body portion to swing laterally toward and away from the body portion. Each of the drill booms support at their end portions drill units that are vertically movable into position adjacent the mine roof for drilling bolt holes and installing roof bolts in accordance with a preselected pattern in the mine roof. Vertically and laterally extensible roof supports are mounted on the body portion and temporarily support the mine roof during the roof bolting and mining operations. Additional features include remote control of the continuous mining machine rearwardly thereof at a location beneath a supported section of the mine roof and remote control of adjustable roof support units that are mounted on the continuous mining machine.

16 Claims, 6 Drawing Figures

METHOD AND APPARATUS FOR ROOF BOLTING AND TRANSFERRING MINED MATERIAL

BACKGROUND OF THE INVENTION

1. Field of the Invention

This invention relates to a method and apparatus for continuously transferring material dislodged from a mine face by a continuous mining machine into a shuttle car for removal from the mine, and more particularly to a material transfer apparatus that includes mechanically adjustable roof supports that engage the mine roof and support the roof during the drilling of bolt holes and the installation of roof bolts in the mine roof by roof drilling units that are mounted on the material transfer apparatus.

2. Description of the Prior Art

In the past, it has been the practice in underground mining of coal and other minerals to dislodge a given section of the mine face, for example ten to twenty feet, and then interrupt the mining operation to install wooden pillars and cross members and more recently hydraulic jacks to temporarily support the mine roof. The mining machine was then removed from the face and a roof bolter brought into position for the installation of permanent roof support. Not only was this method of temporarily supporting the mine roof unsafe but it interrupted the mining operation.

More recently, material transferring apparatus, such as disclosed in U.S. Pat. No. 3,456,982, have been developed for receiving material dislodged from the face by a continuous mining machine. The transfer apparatus includes a longitudinal conveyor that remains in material receiving relationship with the continuous mining machine. The material is deposited onto the conveyor and removed from the face as roof bolting equipment carried by the transfer apparatus installs roof bolts in the mine roof immediately behind the advancing mining machine.

U.S. Pat. No. 3,268,258 discloses a material conveying and roof bolting apparatus that includes a self-propelled longitudinal conveyor that is adapted to receive mined material from a continuously advancing mining machine and to perform roof drilling and bolting operations without interrupting the conveying away of the mined materials. The material receiving end portion of the conveyor includes a hopper which underlaps the mining machine conveyor and into which the dislodged material is deposited. The main conveyor then transports the dislodged material rearwardly from the hopper of the discharge end that includes a discharge conveyor arranged to pivot about a vertical and horizontal transverse axis. The discharge conveyor deposits the mined material into mine cars or onto another conveyor for removal from the mine.

Roof drilling and bolting devices are immovably secured to the transfer unit at opposed sides of the conveyor. Each of the drilling and bolting units includes a vertically movable boom that positions the roof drilling and bolting unit adjacent the mine roof for drilling the roof hole and installing a roof bolt in the mine roof.

There is a need to provide a vehicle transfer apparatus that coordinates the operation of the continuous mining machine with the removal of the dislodged material from the mine, and provides temporary support roof as permanent roof support is installed during the mining operation and while the mining machine continues to advance into the mine face. The material should be transferred from the mining machine to a haulage vehicle in such a manner to permit the mining machine to operate without interruption during which time roof bolts are installed in the mine roof and temporary roof support is provided during the roof bolting and continuous mining operations. There is also a need for a continuous mining system where temporary roof support is provided while permanent roof supports are installed during the mining operation and the mining machine operator is protected by either temporary or permanent roof supports during the mining operation.

SUMMARY OF THE INVENTION

In accordance with the present invention there is provided a method and apparatus for transferring mined material that includes an elongated body portion having ground engaging means for propelling the body portion through a mine. Vertical plate members are secured to opposed sides of the body portion, and a longitudinal main conveyor extends the length of the body portion between the vertical plate members. The main conveyor has a material receiving end portion for continuously receiving material dislodged from the mine face and a material discharging end portion for transferring the mined material from the main conveyor for subsequent handling. Roof drilling units are pivotally mounted on and are vertically movable relative to the body portion. The roof drilling units are operable to drill bolt holes and install roof bolts in the mine roof as the mined material is continuously transferred onto the main conveyor. Actuating devices are provided on the body portion for laterally swinging the roof drilling units about a vertical axis.

The actuating devices are also operable to extend the roof drilling units longitudinally to drill bolt holes and install roof bolts at preselected locations in the mine roof. Roof supports are mounted on the body portion and are operable to support the mine roof as mined material is being continuously received by the main conveyor and roof bolts are being installed by the roof drilling units. A continuous mining machine is operable to dislodge material from the mine face and convey the mined material onto the main conveyor material receiving end portion. The continuous mining machine is provided with roof supports and is remotely controlled from a position beneath a supported section of the mine roof rearward of the mining machine.

The roof drilling units include a pair of horizontally extensible drill booms that are pivotally mounted to opposed sides of the body portion. Each of the boom members includes a first arm member and a second arm member that is arranged to extend and retract longitudinally within the first arm member. A drill is mounted for vertical movement on the end portion of the second arm member. The drill is operable to drill bolt holes and install roof bolts in the mine roof as mined material is being continuously transferred by the main conveyor. A first actuating device swings the first boom arm member in a horizontal plane laterally toward and away from the body portion. A second actuating device connects the second arm member to the first arm member and is operable to longitudinally extend and retract the second arm member relative to the first arm member. In this manner, parallel spaced transverse rows of roof bolts are installed in the mine roof or in accordance with any preselected roof bolt pattern.

The main conveyor continuously transfers material dislodged by a mining machine that progressively advances through the mine to a shuttle car that is positioned in material receiving relationship with the end portion of the main conveyor. During the mining and material transferring operations the roof drilling units install roof bolts in the mine roof. Furthermore, the roof above the material transfer apparatus and the continuous mining machine have mechanically actuated roof supports. The roof supports include pairs of telescoping jacks that are mounted on the body portion of both the transfer apparatus and the mining machine. Each of the telescoping jacks includes a first tubular member rigidly secured on the body portion and a second tubular member that is concentrically positioned in the first tubular member to vertically extend and retract relative thereto. A transverse beam member connects each of the opposed pairs of telescoping jack second tubular members. The transverse beam member may include extension arms that are laterally movable to support the mine roof adjacent the rib sections. In one embodiment the mining machine has longitudinally extending beam roof supports on opposite sides of the mining machine located within four feet of the rib or side wall. The longitudinal beams each have pairs of telescoping jacks that may be separately actuated so that a portion of the roof may be supported adjacent one rib and the personnel are protected while checking for gas or moving the vent tube toward the face.

Accordingly, the principal object of the present invention is to provide a method and apparatus for transferring mined material from a continuous mining machine to a shuttle car by a longitudinal conveyor that is mounted on a movable body portion and provided with roof bolters pivotally mounted on the body portion for installing roof bolts in the mine roof and temporary mechanical roof supports that support the mine roof during the roof bolting and continuous mining operations.

Another object of the present invention is to provide a method and apparatus for continuously conveying mined material dislodged from a mine face by a continuous mining machine and transferring the material by a conveyor into a shuttle car for removal from the mine as roof bolting and mining operations are being simultaneously performed.

Another object of the present invention is to provide a mining system having a material handling apparatus and a continuous mining machine both equipped with mechanically actuated roof supports that are vertically and laterally extensible to engage the mine roof. The roof supports on the material handling apparatus engage the roof and provide temporary roof support during the roof bolting and mining operations.

Still another object of the present invention is to provide material handling apparatus that controls the transfer of mined material from the conveyor of a continuous mining machine to a shuttle car and provides temporary roof support as roof bolters mounted on the apparatus drill bolt holes in the mine roof and install roof bolts therein in accordance with a preselected pattern.

An additional object of the present invention is to provide a material transfer vehicle that includes roof bolters to install roof bolts in a mine roof as the continuous mining machine progressively advances through the mine and the dislodged material is continuously transferred from the face by a longitudinal conveyor onto a shuttle car for removal from the mine.

A further object of the present invention is to provide a material handling apparatus that includes provision to remotely control the continuous mining operation from a location rearward thereof beneath portions of the ming roof supported by either a temporary roof support or by roof bolts and mechanically adjustable roof supports mounted on the apparatus.

These and other objects of the present invention will be more completely disclosed and described in the following specification, the accompanying drawings and appended claims.

DESCRIPTION OF THE PREFERRED EMBODIMENTS

Figure 1:
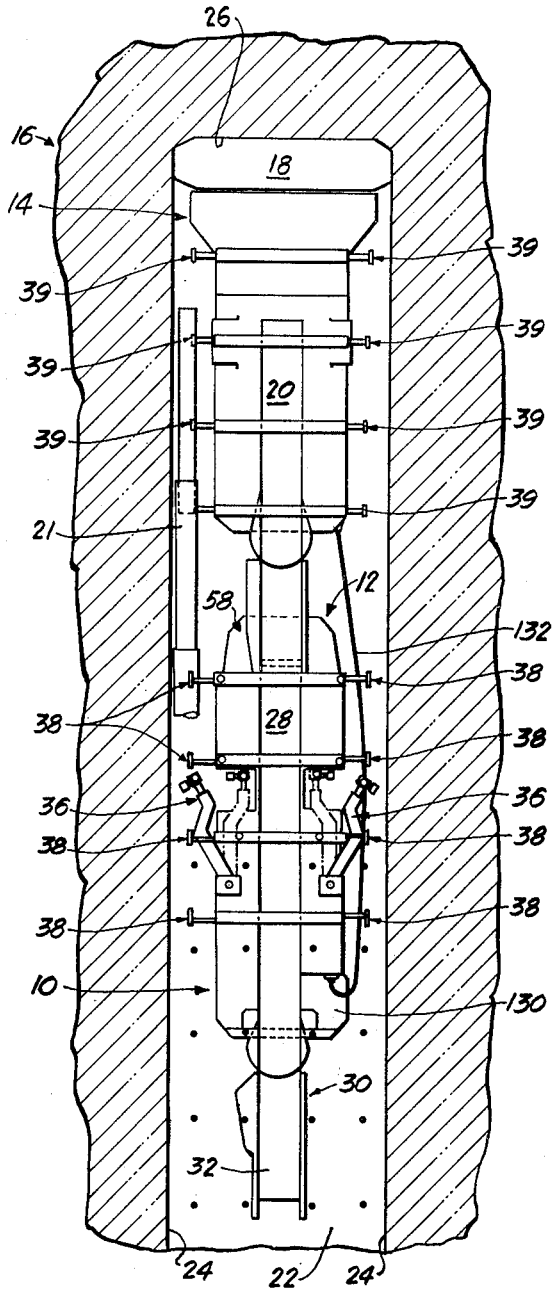
FIG. 1 is a schematic plan view of an underground mine, illustrating the material transfer apparatus positioned to receive mined material that is continuously dislodged from the mine face by the remotely controlled mining machine and to transfer the material rearwardly from the face while bolt holes and roof bolts are installed in the mine roof and adjustable roof supports on the transfer apparatus support the mine roof.
Figure 3:
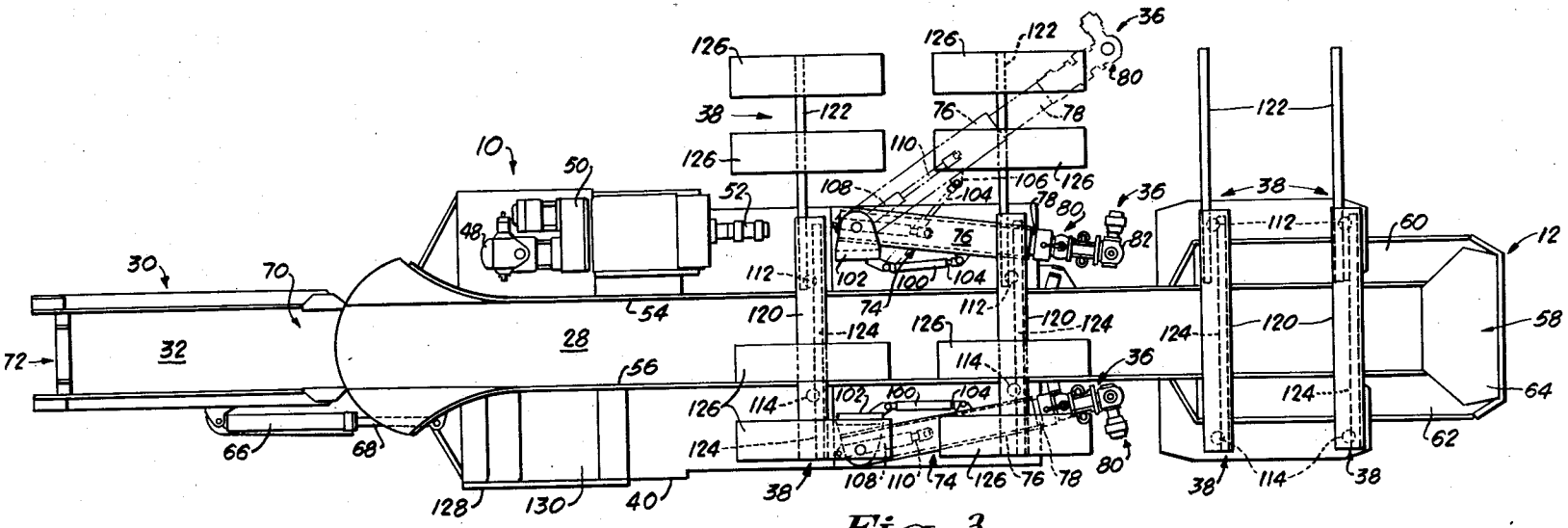
FIG. 3 is a plan view of the material transfer apparatus, illustrating the relative movement of the roof bolters pivotally mounted to the forward end portion of the apparatus and the vertically and laterally extensible roof supports mounted on the apparatus.
Figure 4:
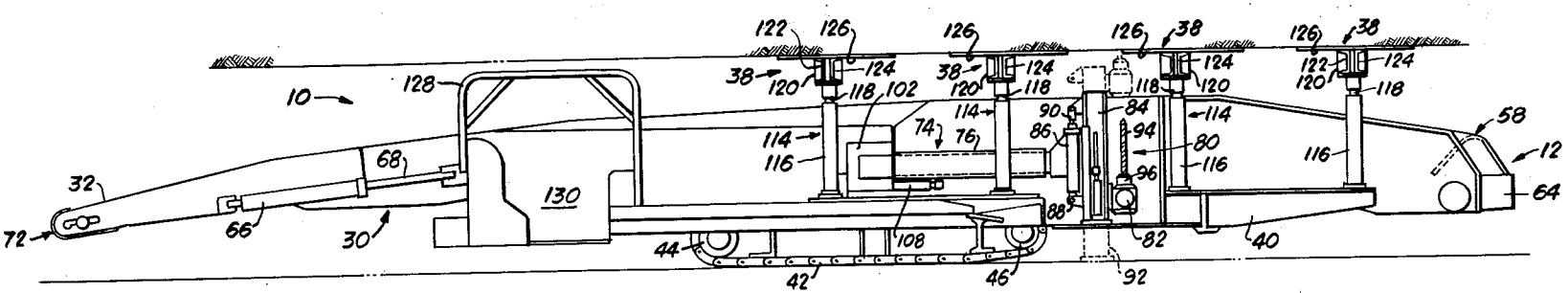
FIG. 4 is a view in side elevation of the material transfer apparatus illustrated in FIG. 3.

Referring to the drasings, and more particularly, to FIGS. 1, 3 and 4, there is illustrated apparatus for transferring mined material generally designated by the numeral 10 having a material receiving end portion 12 positioned adjacent the rearward end portion of a continuous mining machine 14. The mining machine 14 may be of any conventional type, such as a boring-type mining machine that operates in an underground mine 16 and has a cutting head 18 and a conveyor 20 extending rearwardly therefrom. The mining machine 14 continuously advances through an entry 22 having ribs or side walls 24 and a front face 26. The entry 22 is formed by the mining machine cutting head 18 continuously dislodging material from the face 26.

The material dislodged from the face 26 is conveyed rearwardly by the mining machine conveyor 20 onto the material receiving end portion 12 of a main conveyor 28 that extends longitudinally the length of the transfer apparatus 10. The main conveyor 28 moves the material from the receiving end portion 12 to a material discharging end portion 30. The material discharging end portion 30 includes an end conveyor 32 that is connected to the main conveyor 20 to pivot relative thereto about a fixed vertical axis.

Figures 2, 6:
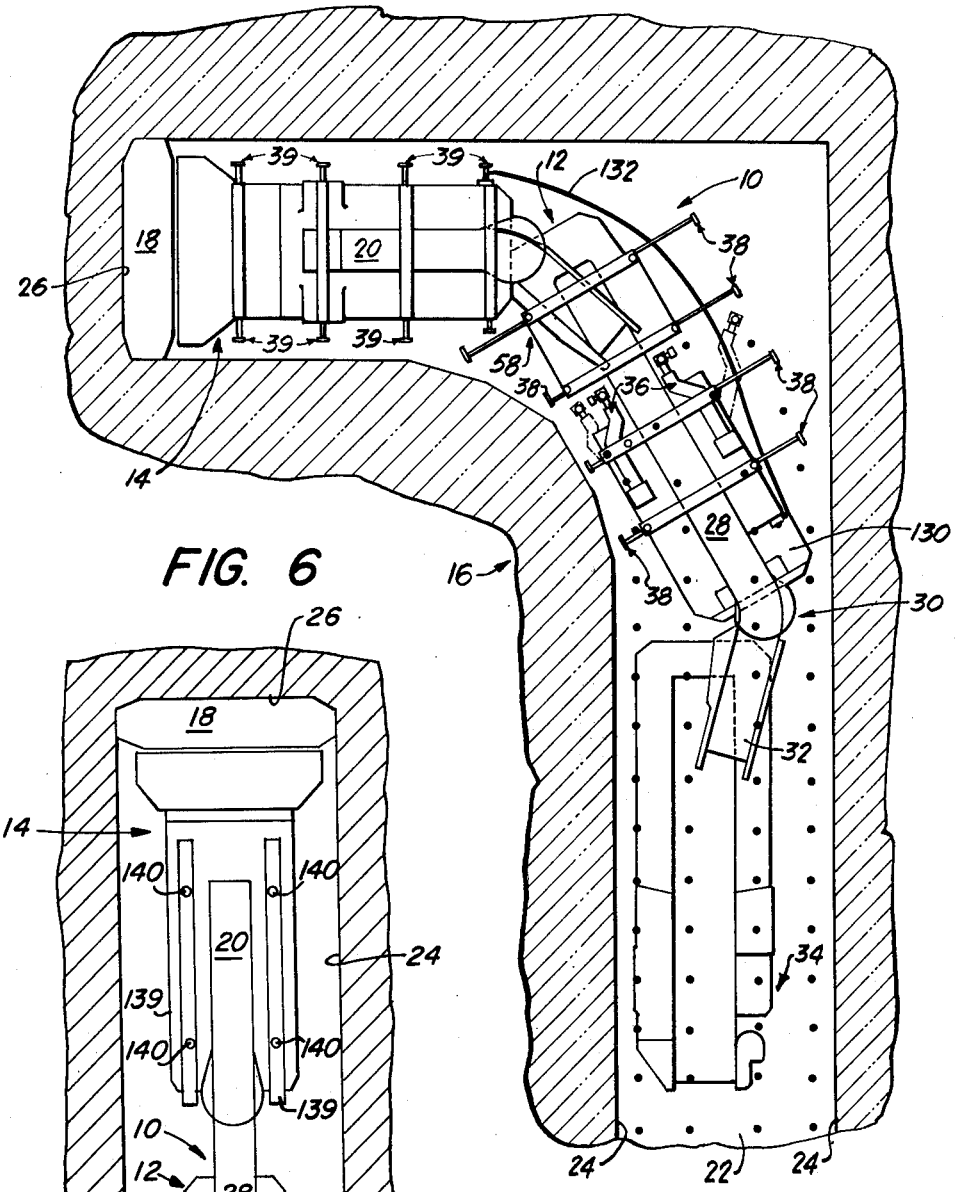
FIG. 2 is a schematic plan view similar to FIG. 1, illustrating the operation of the transfer apparatus to transfer dislodged material from the continuous mining machine into a shuttle car for removal from the mine.
FIG. 6 is a fragmentary plan view similar to FIG. 1 of the continuous mining machine having longitudinally extending roof supports on opposite sides of the mining machine.

A shuttle car 34, as illustrated in FIG. 2, is adapted to be moved under the discharge end of the end conveyor 32 and filled with the mined material from the main conveyor 28. As the mined material is continuously transferred from the mining machine conveyor 20 to the shuttle car 34 by the transfer apparatus conveyor 28, roof bolters 36 pivotally mounted on opposed sides of the apparatus 10 drill holes and install roof bolts in the mine roof for support of the mine roof. Furthermore, roof support is provided by a plurality of mechanically actuated roof supports 38 that are provided on the material transfer apparatus 10. The mining machines illustrated in FIGS. 1 and 2 have transversely extending roof supports 39 that are arranged to provide temporary roof support above the mining machine 14 when the mining machine is not advancing into the mine face and dislodging material therefrom. The mining machine illustrated in FIG. 6 has a pair of longitudinally extending roof supports 139 that are arranged to be separately extended to provide temporary roof support along one or both sides of the mining machine 14 while the mining machine is idle and not dislodging material and personnel are working adjacent the face along the side of the mining machine. The roof supports 38 and 39 are vertically movable and laterally extensible to abut the mine roof adjacent the mine ribs 24.

As illustrated in FIGS. 3 and 4, the material transfer apparatus 10 includes an elongated relatively narrow body portion 40 that is mounted on and supported by ground engaging tractor treads 42 passing around sprockets 44 and 46, one of which is driven. The body portion preferably has a narrow width as compared with the width of the entry to provide ample room on both sides of the transfer apparatus for personnel to work at the roof bolters and also to have access to the mining machine 14 without crawling over components of the transfer apparatus 10. A prime mover 48 is mounted on the body portion 40 and is drivingly connected to a shaft (not shown) through transmission 50. The shaft is rigidly secured to a selected one of the sprockets 44 and 46 for driving the sprocket to continuously move the endless tractor treads 42 and propel the body portion 40 through the mine. The motor 48 is also employed for operating a fluid pump 52 that supplies fluid under pressure to the various hydraulic cylinders and jacks provided on the body portion 40 and described hereinafter.

The body portion 40 of the material transfer apparatus 10 includes vertical plate members 54 and 56 that are secured in spaced parallel relationship to the opposed sides of the body portion 40. The vertical plate members 54 and 56 thus form a longitudinal passageway in which the main conveyor 28 is positioned. The longitudinal passageway and the conveyor 28 are also both relatively narrow and are intended to substantially continuously transfer the dislodged material from the mining machine and not store large volumes of dislodged material as is the purpose of the surge type transfer vehicle. Preferably, the main conveyor 28 is a flight-type conveyor having an endless chain with conveyor flights extending laterally therefrom. The endless chain of the main conveyor passes over sprockets (not shown) that are driven by the motor 48 through the transmission 50. With this arrangement, the vertical plate members 54 and 56 serve to confine the mined material within the conveying path of the main conveyor 28 as it transports the mined material from the material receiving end portion 12 to the material discharging end portion 30.

The material receiving end portion 12 includes a receiving hopper 58 into which material is continuously deposited from the mining machine 14 and conveyed therefrom by the main conveyor 28 to the material discharging end portion 30. The receiving hopper 58 includes a pair of opposed inclined side walls 60 and 62 extending outwardly from the main conveyor 28. The end portions of the side walls 60 and 62 are connected to an inclined end wall 64. With this arrangement, as illustrated in FIGS. 1 and 2, the receiving hopper 58 is constantly maintained in underlying relationship with the discharge end of the mining machine conveyor 20 even as the mining machine is turning as illustrated in FIG. 2. The material is dislodged from the mine face 26 and is continuously discharged into the receiving hopper 58 thus permitting the mining machine 14 to operate without interruption.

As the mined material is deposited into the receiving hopper 58, the main conveyor 28 transports the material to the end conveyor 32 at the material discharging end portion 30. The end conveyor 32 is maintained in overlying relationship with the material receiving end portion of the shuttle car 34, as illustrated in FIG. 2. Accordingly, the material transfer apparatus 10, by remaining in material receiving relationship with the conveyor 20 of the mining machine 14 and in material discharging relationship with shuttle car 34, provides for continuous movement of the mined material from the mining machine 14 to the shuttle car 34. Thus, the continuous operation of the mining machine 14 is not interrupted as the mined material is dislodged from the mine face 26 and the shuttle car 34 is loaded.

The end conveyor 32 of the main conveyor 28 is adapted to be positioned in overlying relationship with the shuttle car 34 and comprises a flight-type conveyor, having double flights that are secured to an endless chain that passes over driven sprockets. A hydraulic cylinder 66 having an extensible piston 68 provided therein is laterally mounted to one side of the end conveyor 32. The extensible piston 68 is pivotally connected to the body portion 40.

The end conveyor 32 includes a receiving end portion 70 and a discharge end portion 72. The receiving end portion 70 is connected to the end portion of the main conveyor 28 to pivot relative thereto about a fixed vertical axis. Operation of the hydraulic cylinder 66 to extend and retract the piston 68 moves the end conveyor discharge end portion 72 in a horizontal arcuate path relative to the main conveyor 28. In this manner, the end conveyor 32 is moved to a preselected location and the axial position thereof with respect to the shuttle car 34 is determined.

As illustrated in FIG. 2, the end conveyor 32 may be pivoted relative to the main conveyor 28 to remain in material discharging relationship with the shuttle car 34. Thus, as the mining machine 14 progresses through the mine entry 22 and continuously dislodges material from the mine face 26, the main conveyor 28 and the end conveyor 32 continuously transfer the mined material to the shuttle car 34. In this manner the shuttle car 34 is loaded, and the mined material is removed from the mine.

As the mined material is continuously transferred from the mining machine 14 to the shuttle car 34 by the main conveyor 28, bolt holes are drilled in the mine roof and roof bolts are installed therein by the roof bolters 36 that are laterally mounted opposite one another on the body portion 40. As illustrated in FIGS. 3 and 4, each of the roof bolters 36 includes a horizontally extensible drill boom generally designated by the numeral 74 that is pivotally mounted to the body portion 40. The drill boom 74 includes a first arm member 76 that is pivotally secured at its rearward end portion to the body portion 40. The forward end portion of the first arm member 76 is slidably connected to a second arm member 78 that is arranged to extend and retract longitudinally relative to the first arm member 76.

A roof drilling unit 80 is mounted to the forward end portion of the second arm member 78 and includes a rotary drill 82 that is mounted for slidable vertical movement on a telescoping mast 84 secured to the arm member 78. A hydraulic cylinder 86 is mounted to a bracket 88 of mast 84 and is provided with an extensible piston 90 that is secured to the upper end portion of mast 84. The hydraulic cylinder 86 is operable upon actuation to vertically extend the piston 90 and thereby raise the mast 84 together with the drill 82 into drilling position adjacent the mine roof, as illustrated in phantom in FIG. 4. The lower end portion of the mast 84 is provided with a floor jack 92 that extends downwardly to engage the mine floor and brace the roof bolter 36 during the roof drilling and bolting operations.

The drill 82 has a drill steel 94 that is nonrotatably secured in a drill chuck 96. A drill bit is secured to the end of the drill steel 94, and the motor of the drill 82 rotates the drill steel and the drill bit. Once the bolt holes are drilled in the mine roof, the drill steel 94 is removed from the chuck 96, and a roof bolt assembly is inserted therein. The drill 82 is vertically raised to position the roof bolt assembly in the drilled bolt hole. Rotation of the drill motor secures the bolt assembly in the mine roof.

The drill booms 74 are laterally pivotal toward and away from the body portion 40 by operation of a hydraulic cylinder 100. The cylinder 100 is connected to a bracket 102 that is mounted on the body portion 40 and pivotally secures the first arm member 76 thereto. The hydraulic cylinder 100 is provided with an extensible piston 104 having an end portion that is secured to a bracket 106 of the arm member 76. Extension of the piston 104 out of the hydraulic cylinder 100 produces horizontal pivotal movement of the first arm member 76 about the bracket 102 to swing the boom arm 76 outwardly from the body portion 40, as illustrated in phantom in FIG. 3. In this manner, the roof bolters 36 may be moved laterally toward and away from the body portion 40 to drill bolt holes and install roof bolts at preselected locations in the mine roof in accordance with a predetermined pattern as illustrated in FIGS. 1 and 2. Preferably, the roof bolters 36 are operated so as to drill bolt holes and install roof bolts transversely in a straight line across the mine roof from rib to rib.

The second boom arm member 78 is slidably received within the first boom arm member 76 to extend and retract relative thereto. A hydraulic cylinder 108 is secured to the bracket 102 as illustrated in FIGS. 3 and 4 and has an extensible piston rod 110 that is secured to the end portion of the second boom arm member 78 positioned within the first boom arm member 76. Actuation of the hydraulic cylinder 108 outwardly extends the piston rod 110 to thereby extend the boom arm 78 out of the boom arm 76. In this manner, the roof bolters 36 are horizontally extended a preselected distance for positioning the roof drilling units 80 to install in the mine roof a transverse row of roof bolts spaced from a preceding transverse row of roof bolts installed in the mine roof. Accordingly, as roof bolts are being installed in the mine roof the mined material is continuously dislodged from face by the mining machine 14 and transferred from the mine face by the conveyor 28 to the shuttle car 34.

As illustrated in FIGS. 3 and 4, the roof bolters 36 extend forwardly on the body portion 40 toward the mining machine 14. This arrangement provides for the installation of roof bolts adjacent the mine face to thereby support the roof adjacent the mine face. Thus the risk of a roof fall occurring above the mining machine 14 is substantially reduced.

Figure 5:
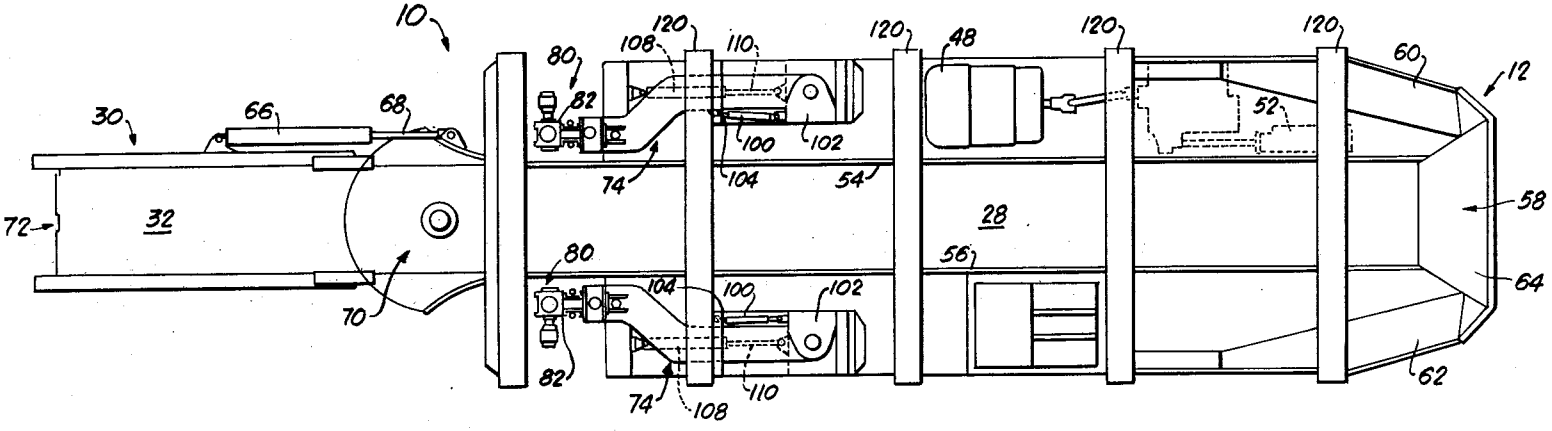
FIG. 5 is a plan view of the material transfer apparatus, illustrating the roof supports in retracted position of the apparatus and the roof bolters pivotally mounted to the rearward end portion of the apparatus.

In FIG. 5, there is illustrated another embodiment of the present invention in which like numerals refer to like parts illustrated in FIGS. 3 and 4. In FIG. 5, the roof bolters 36 extend rearwardly toward the end conveyor 32. With this arrangement, the drill booms 74 are pivotally mounted on the body portion 40 to swing laterally toward and away from the body portion 40. Each of the drill booms 74 are longitudinally extended rearwardly by operation of the cylinders 108 in the manner hereinbefore described. Thus, the drill booms 74, illustrated in FIG. 5, are operable to position the roof drilling units 80 for the installation of roof bolts in the mine roof in a straight line pattern extending transversely from rib to rib.

While the roof bolting and continuous mining operations are being performed, and the dislodged material is continuously conveyed from the mine face by the conveyor 28 into the shuttle car 34, temporary roof support is provided by the mechanical roof supports 38. As illustrated in FIGS. 3 and 4, the temporary mechanical roof supports 38 include pairs of telescoping jacks 112 and 114 that are mounted on opposed sides of the body portion 40. Each of the telescoping jacks 112 and 114 includes a first tubular member 116 that is rigidly secured to the body portion 40 and a second tubular member 118. The second tubular member 118 is concentrically positioned in the first tubular member 116 to vertically extend and retract relative thereto. Power actuated devices (not shown) are operable to vertically extend the second tubular member 118 relative to the first tubular member 116.

The pairs of roof support jacks 112 and 114 are connected by an overhead transverse beam member 120. The beam members 120 are rigidly secured to the second tubular members 118 of each of the pairs of roof support jacks 112 and 114. With this arrangement, actuation of the roof support jacks 112 and 114 to vertically raise the second tubular members 118 positions the beam members 120 in abutting relation with the mine roof.

Each of the beam members 120 has the configuration of a T-bar in which are slidably positioned extension arms 122 and 124. A suitable power actuated device (not shown) is operable to advance the extension arms 122 and 124 laterally out of the beam members 120 to a position adjacent the mine ribs 24. In this manner, extension arms 122 and 124 provide roof support at the rib sections and thereby transfer the load stresses in the mine roof exerted upon the transverse beam members 120 to the solid rib areas. Thus, temporary mine roof support is provided during the roof bolting and continuous mining operations without interrupting either of these operations. In this manner improved safety from roof falls is provided at the mine face and production of the mined material increased by eliminating interruption of the mining operation. In FIG. 5, the extension arms 122 and 124 are shown retracted within the beam members 120.

Referring to FIGS. 3 and 4, the beam members 120 may be provided with a plurality of roof support plates 126 that are secured to and positioned in spaced parallel relationship on the upper surface of each of the beam members 120. Vertical extension of the roof support jacks 112 and 114 urges the roof support plates 126 on beam members 120 into abutting relation with the mine roof. The roof support plates 126 serve to increase the surface area of the mine roof being supported by the roof supports 38. In addition, the roof support plates 126 may be secured in spaced relation to the extension arm 122 and 124. Positioning the extension arms 122 and 124 having the roof support plates 126 adjacent the rib sections serves to increase the surface area of the mine roof supported at the rib sections to provide a more effective roof support.

The mechanical roof supports 38 support the mine roof during the roof drilling and bolting operations and further function to provide roof support in close proximity to the continuous mining machine 14 operated in advance of the material transferring apparatus 10.

In addition to the overhead protection provided by mechanical roof supports 38, the mechanical roof supports 39 illustrated in FIGS. 1 and 2 and 139 illustrated in FIG. 6 are provided to support the mine roof above the continuous mining machine 14 when the mining machine 14 is not advancing into the mine face and dislodging material therefrom. The roof supports 39 and 139 thus provide roof support over the mining machine when personnel are in a location along the side of the mining machine 14. The roof supports 39 are similar to roof supports 38 above described and illustrated in FIGS. 3 and 4. Actuation of the roof supports 39 to engage the mine roof provides roof support adjacent the mine face 26 to permit testing for gas at the face and positioning of ventilating tube 21 within the required distance from the face under the safest possible conditions. As later explained, the longitudinal supports 139 may be separately actuated to provide support along one rib 24.

The material transfer apparatus includes an operator's compartment 130 that is protected by an overhead canopy 128. As illustrated in FIGS. 1 and 2, the operation of the continuous mining machine 14 may be remotely controlled by a remote control conduit 132 that extends rearwardly from either side of the mining machine 14 to a location for example adjacent the operator's compartment 130. The conduit 132 may contain fluid or electric conductors that actuate selected valves or switches on the mining machine 14 to operate the various controls mounted on the mining machine. An alternative means for remotely controlling the operation of the mining machine 14 from the operator's compartment 130 is through a radio transmitter and receiver combination. Thus, the mining machine operator is able to work under a portion of the mine roof that is supported by either roof bolts or the mechanical roof supports 38. Provision may also be made to remotely control actuation of the roof supports 39 or 139 provided on the mining machine 14 by a remote control conduit or through a radio transmitter and receiver. In a specific embodiment operation of the continuous mining machine 14 and roof supports 39 may be remotely controlled from the canopied operator's compartment 130.

In FIG. 6, the mining machine 14 has a pair of longitudinally extending roof supports 139 that are mounted along the side of the machine 14 at about 4 feet from the ribs 24. Each of the supports 139 has at least a pair of telescopic hydraulic jacks 140 that are arranged to extend the supports 139 into abutting relation with the mine roof. The hydraulic jacks are suitably arranged so that either or both of the supports 139 may be moved into a roof supporting position. With this arrangement either side of the entry along the side of the mining machine 14 may be supported while personnel are working along that side of the mining machine performing duties such as testing for gas or advancing the vent tubing.

In operation, the material transfer apparatus 10 is initially advanced in the mine to a position where the storage hopper 58 abuts the rear bumper of the mining machine 14. The mining machine conveyor 20 is positioned in overlying relationship with the receiving hopper 58 and the main conveyor 28. The roof bolters 36 are selectively positioned for drilling bolt holes into the mine roof, and the floor jacks 92 are extended to engage the mine floor and rigidly brace the roof bolters 36. The extension arms 122 and 124 are projected laterally from the beam members 120 to a position adjacent the mine ribs. The roof support jacks 112 and 114 raise the beam members 120 and extension arms 122 and 124 to contact the mine roof. Thereafter, the roof drilling and bolting operations are commenced as the mining machine 14 advances into the mine face.

The material dislodged from the face is transferred from the conveyor 20 onto the conveyor 28 and into the shuttle car 34. With this arrangement, having the mining machine conveyor 20 positioned in material receiving relationship with the transfer apparatus conveyor 28, the mining machine 14 can advance a selected distance as the transfer apparatus 10 remains stationary in the mine and the shuttle car 34 is loaded. When the mining machine 14 has advanced a preselected distance, with the conveyor 20 remaining in overlying relation with the hopper 58, such as illustrated in FIG. 1, the roof supports 38 are lowered from contact with the mine roof and the floor jacks 92 are raised from contact with the ground. The drill booms 74 of the roof bolters 36 are pivoted from their outwardly extended position toward the body portion 40, as illustrated in phantom in FIG. 1. The material transfer apparatus 10 is then forwardly propelled to a position where the receiving hopper 58 is positioned in abutting relation with the rear end portion of mining machine 14 which has also forwardly advanced in the mine. Once again, the roof supports 38 are vertically extended into contact with the mine roof as the roof bolting and mining operations continue. In this manner the main conveyor 28 remains in material receiving relationship with mining machine conveyor 20.

Preferably the material transfer apparatus is advanced in increments so that the bolters may insert a row of bolts in the roof at a preselected distance from the last row of bolts. The roof supports 39 and 139 on the mining machine are extended when the mining machine is not advancing into the face to provide roof support above the mining machine.

According to the provisions of the patent statutes, I have explained the principle, preferred construction and mode of operation of my invention and have illustrated and described what I now consider to represent its best embodiments. However, I desire to have it understood that, within the scope of the appended claims, the invention may be practiced otherwise than as specifically illustrated and described.

I claim:

1. Apparatus for transferring mined material comprising, an elongated body portion having ground engaging means for propelling said body portion through a mine, vertical plate members secured to opposed sides of said body portion, a longitudinal main conveyor extending the length of said body portion between said vertical plate members, said main conveyor having a material receiving end portion for continuously receiving material dislodged from the mine face and a material discharging end portion for transferring the mined material from said main conveyor for subsequent handling, roof drilling means pivotally mounted on said body portion to swing laterally toward and away therefrom and vertically movable relative to said body portion for drilling bolt holes and installing roof bolts in the mine roof, actuating means for laterally swinging said roof drilling means about a vertical axis and extending said roof drilling means horizontally to drill bolt holes and install roof bolts at preselected locations in the mine roof, roof support means mounted on said body portion for supporting the mine roof as mined material is being continuously received by said main conveyor and roof bolts are being installed by said roof drilling means, said roof support means being vertically and laterally extensible to engage the mine roof, and a continuous mining machine operable to dislodge material from the mine face and convey the mined material onto said main conveyor material receiving end portion being maintained in material receiving relation with said continuous mining machine.

2. Apparatus for transferring mined material as set forth in claim 1 in which said roof support means includes, pairs of telescoping devices mounted on opposed sides of and positioned substantially the entire length of said body portion, each of said telescoping devices having a first member rigidly secured to said body portion and a second member concentrically positioned in said first member to vertically extend and retract relative thereto, a transverse horizontally extensible beam member connecting each of said opposed pairs of telescoping devices second members and being positioned transversely above said body portion, and a plurality of longitudinally extending, spaced parallel roof support plates secured to the end portions of each of said beam members, said roof support plates being horizontally movable with said beam members to extend and retract laterally relative to said support frame to provide roof support laterally of said body portion and adjacent the mine rib.

3. Apparatus for transferring mined material as set forth in claim 2 which includes, said telescoping devices operable to vertically raise said transverse beam members and position said roof support plates in abutting relation with the mine roof.

4. Apparatus for transferring mined material as set forth in claim 1 which includes, an operator's compartment provided on said support frame, said operator's compartment being protected by an overhead canopy and located under the portion of the mine roof being supported by roof bolts installed by said roof drilling means.

5. Apparatus for transferring mined material as set forth in claim 1 which includes, remote control means for controlling the dislodging of material from the mine face, said remote control means operably positioned at a location remote from said mining machine and beneath a supported section of the mine roof.

6. Apparatus for transferring mined material as set forth in claim 5 in which said remote control means includes, a remote control conduit operably connected to said continuous mining machine and extending rearwardly therefrom to a position beneath said roof supporting means on said body portion.

7. Apparatus for transferring mined material as set forth in claim 1 in which said roof drilling means includes, a horizontally extensible boom member pivotally mounted to and at each side of said support frame, and drill means mounted for vertical movement on the end portion of each of said boom members, said drill means operable to drill bolt holes and install roof bolts in the mine roof as mined material is being continuously transferred from the mine face by said main conveyor.

8. Apparatus for transferring mined material as set forth in claim 7 which includes, said extensible boom member having a first arm member pivotally secured to said support frame, and a second arm member connected to said first arm member, said second arm member being arranged to extend and retract longitudinally relative to said first arm member.

9. Apparatus for transferring mined material as set forth in claim 8 which includes, said actuating means including a first power actuated piston cylinder assembly for swinging said boom first arm member in a horizontal plane laterally toward and away from said body portion, and a second power actuated piston cylinder assembly connecting said boom first arm member to said boom second arm member and operable to longitudinally extend and retract said boom second arm member relative to said boom first arm member.

10. Apparatus for transferring mined material as set forth in claim 1 which includes, roof support means mounted on said continuous mining machine for supporting the mine roof above said mining machine adjacent the mine face, and said roof support means including extensible transversely positioned support members operable to extend transversely and support the mine roof adjacent the rib sections.

11. Apparatus for transferring mined material as set forth in claim 10 in which said roof support means on said mining machine includes, a pair of longitudinally extending roof support beam members positioned on opposite sides of said mining machine, means for separately moving one of said roof support beam members into abutting relation with the mine roof and provide roof support adjacent one side of an entry above said mining machine.

12. A method of transferring mined material comprising, conveying mined material dislodged from the face of a mine by a continuous mining machine into a material transfer apparatus positioned at one end portion in material receiving relationship with said continuous mining machine, conveying the mined material longitudinally in said material transfer apparatus and into a haulage vehicle arranged to move into and out of material receiving relationship with the other end portion of said material transfer apparatus, supporting the mine roof above said material transfer apparatus and adjacent the mine ribs substantially the entire length of said material transfer apparatus while said mining machine is dislodging material from the mine face, drilling holes in the mine roof above said material transfer apparatus by a pair of roof drilling units mounted for horizontal pivotal movement on and vertically movable relative to the body portion of said material transfer apparatus, installing roof bolts in the drilled holes by said roof drilling units as the mined material is being dislodged and conveyed from the mine face, and controlling said continuous mining machine to dislodge material from the mine face from a position remote of said continuous mining machine and beneath a supported section of the mine roof adjacent said material transfer apparatus.

13. A method of transferring mined material as set forth in claim 12 which includes, drilling bolt holes and installing roof bolts in the mine roof by said roof drilling units transversely in a straight line across the mine roof.

14. A method of transferring mined material as set forth in claim 12 which includes, extending and retracting said telescoping roof support devices laterally and horizontally to support the mine roof above said material transfer apparatus and adjacent the mine ribs.

15. A method of transferring mined material as set forth in claim 12 which includes, pivoting said roof drilling units laterally on said material transfer apparatus and longitudinally extending said roof drilling units to drill bolt holes and install roof bolts in the mine roof transversely in a straight line across the width of the mine entryway.

16. A method of transferring mined material as set forth in claim 12 which includes, supporting the mine roof above said continuous mining machine by a plurality of other telescoping roof support devices mounted on said continuous mining machine, and supporting a portion of the mine roof above said continuous mining machine adjacent the mine rib opposite said continuous mining machine.

* * * * *